United States Patent [19]

Lamar

[11] Patent Number: 5,050,800

[45] Date of Patent: Sep. 24, 1991

[54] FULL RANGE SPRINKLER NOZZLE

[76] Inventor: John W. Lamar, P.O. Box 1107, Oak View, Calif. 93022

[21] Appl. No.: 500,723

[22] Filed: Mar. 28, 1990

Related U.S. Application Data

[63] Continuation-in-part of Ser. No. 319,357, Mar. 6, 1989, abandoned.

[51] Int. Cl.[5] ..... B05B 1/16

[52] U.S. Cl. ..... 239/201; 239/444; 239/561; 239/562; 239/DIG. 1

[58] Field of Search ..... 239/200, 201, 207, 390, 239/436, 443, 444, 520, 524, 548, 561, 562, DIG. 1

[56] References Cited

U.S. PATENT DOCUMENTS

| | | | |
|---|---|---|---|
| 1,881,409 | 10/1932 | Le Moon | 239/396 |
| 2,190,639 | 2/1940 | Wittek | 239/390 |
| 2,619,378 | 11/1952 | Watkins et al. | 239/390 |
| 2,634,163 | 4/1953 | Double | 239/520 |
| 2,943,798 | 7/1960 | Rienks | 239/520 |
| 3,272,436 | 9/1966 | Hunter | 239/204 |
| 3,650,478 | 3/1972 | Jones | 239/516 |
| 3,664,590 | 5/1972 | Knight | 239/499 |
| 3,762,650 | 10/1973 | Radecki | 239/444 |
| 3,814,326 | 6/1974 | Bartlett | 239/276 |
| 3,815,832 | 6/1974 | Floyd | 239/563 |
| 3,830,434 | 8/1974 | Green et al. | 239/562 |
| 4,119,275 | 10/1978 | Hunter | 239/456 |
| 4,154,404 | 5/1979 | Clawson | 239/563 |
| 4,189,099 | 2/1980 | Bruninga | 239/200 |
| 4,625,917 | 12/1986 | Torney | 239/446 |
| 4,681,263 | 7/1987 | Cockman | 239/391 |
| 4,739,934 | 4/1988 | Gewelber | 239/446 |

*Primary Examiner*—Andres Kashnikow
*Assistant Examiner*—Karen B. Merritt
*Attorney, Agent, or Firm*—Brown, Martin, Haller & McClain

[57] ABSTRACT

A full range nozzle assembly comprises a nozzle member having a base at one end with an inlet for connection to a water supply via a riser tube, and a head at the opposite end with a plurality of spaced spray orifices arranged in a ring around the periphery of the head member, with internal passageways connecting each spray orifice to the inlet. The orifices are of varying dimensions and are arranged to produce sprays having at least two different arc widths. Removable plugs in the passageways control the connection of each outlet to the inlet, and a flow control device is adjustable mounted in the spray head for controlling the flow rate of water from the supply into the inlet. Precipitation rate control or adjustment is provided by varying the effective cross-section of the respective passageways according to the arc width of the orifice with which they are connected.

14 Claims, 3 Drawing Sheets

FULL RANGE SPRINKLER NOZZLE

CROSS-REFERENCES TO RELATED APPLICATIONS

This application is a continuation-in-part of my application Ser. No. 07/319,357 filed Mar. 6, 1989, entitled "Fully Adjustable Sprinkler Nozzle", now abandoned.

BACKGROUND OF THE INVENTION

1. Field of the Invention

This invention relates generally to water sprinklers and is particularly concerned with the nozzles of sprinkler heads for distributing water over a predetermined pattern on the surrounding ground.

2. Description of Related Art

Water sprinkler or spray heads are typically mounted on submerged water supply pipes at desired locations over an area to be watered. Such heads may be of the travelling type which swing from side to side or rotate in order to move a spray of water to cover an area to be sprinkled. Other heads are fixed to provide a specific spray pattern, such as a quarter circle, half circle or full circle. However, such fixed heads allow only one specific spray pattern, which may not conform to the desired watering area. Thus, such heads have to be replaced with one of different design if it is necessary to change the spray pattern.

Adjustable sprinkler heads are also known, which allow the spray pattern to be varied on installation, so that a single fixed spray head has the capability of providing various different spraying patterns. However, these are subject to some disadvantages in that they do not provide full range adjustability, and are sometimes inconvenient to adjust. For example, U.S. Pat. No. 4,739,934 of Gewelber describes a sprinkler head moulded with a large number of identical small orifices which are initially plugged by light barriers. In order to produce a desired spray pattern, the barriers closing the selected orifices must be punctured. Once punctured, an orifice cannot subsequently be re-closed, limiting the degree of adjustability. Additionally, the punctured barriers produce spurs in the orifice which may disturb or plug the spray. Also, this head is relatively inconvenient and awkward to adjust where a wide angle spray pattern is desired, in view of the large number of barriers which must be punctured.

U.S. Pat. No. 3,830,434 of Green et al. describes another adjustable sprinkler head having four identical orifices. This does not provide a wide range of variation, nor is a full 360 degree spray possible with this sprinkler head. Also, each orifice is associated with a valve member for controlling the flow to that orifice between a fully closed and fully open position. Thus, the spray range from each orifice must be controlled separately. Alteration of the valve opening to one orifice will alter the range from any other open orifices, necessitating repeated adjustment of the valve members when spray from more than one orifice is required. This is particularly inconvenient where the spray head must be removed from the riser pipe for access to the valve members. Additionally, it is extremely difficult, if not impossible, to provide matched precipitation rates from each orifice in this nozzle when adjusted. In other words, for a given flow rate, the amount of water actually sprayed from each orifice will not be matched with the other orifices, so that different areas will receive different amounts of watering.

SUMMARY OF THE INVENTION

It is an object of this invention to provide a new and improved adjustable sprinkler head or nozzle.

According to the present invention, a sprinkler nozzle is provided which comprises a nozzle member having a base at one end and a head at the opposite end, the base having an inlet for connection to a water supply outlet and the head having a plurality of spray orifices arranged in a ring around its periphery for directing radial sprays of different arc widths outwardly in different directions from the spray head. The base has a plurality of internal passageways which connect the inlet to the respective spray orifices. An adjustable flow rate control device controls the flow rate of water into the spray head inlet. A plurality of flow restriction plugs are releasably mounted in the base, each plug being removably mounted in a respective one of the passageways to cut off water supply to the associated spray orifice, and co-operating with the respective passageway to allow selective removal and replacement for adjusting the spray pattern. The orifice dimensions are selected so that each orifice defines a spray pattern of a desired arc width. The cross-sectional areas of the passageways are controlled according to the size of the respective orifice to which they are connected in order to match the precipitation rates from each of the orifices. In other words, the cross-sectional area of a passageway connected to one of the larger orifices will be larger than that of a passageway connected to a smaller orifice, so that the same degree of watering will be provided by each of the orifices. If the two passageways were of identical sizes, and the flow rates into each orifice were the same, clearly a piece of ground watered by the smaller orifice would receive more water than a piece of ground watered by the larger orifice, and the precipitation rates will not be matched.

In one embodiment of the invention, four orifices defining arc widths of $\frac{1}{8}$, $\frac{1}{4}$, $\frac{1}{3}$ and $\frac{1}{2}$ of a circle, or 45°, 90°, 120°, and 180°, are provided. By removal of a selected plug or combination of plugs, spray patterns in a wide range of different arc widths can be provided quickly and easily, and the arc width can be varied subsequently from the original selection simply by replacing and removing other plugs. Apart from the basic arc widths provided by each of the four orifices, combinations of the four orifices will provide arc widths of 135° or 3/8 of a circle, 210°, 255°, 300°, 345°, and a full circle pattern of at least 360° when all four orifices are open. The orifices are preferably arranged sequentially in order of increasing size around the periphery of the spray head. With this orifice size, if the precipitation rates are to be matched, the $\frac{1}{2}$ circle orifice will have a passageway cross-section which will allow twice the water flow of the $\frac{1}{4}$ circle orifice, the $\frac{1}{4}$ orifice passageway cross-section will allow twice the water flow of the $\frac{1}{8}$ circle orifice, while the $\frac{1}{3}$ circle orifice passageway cross-section will allow $\frac{2}{3}$ the water flow of the $\frac{1}{2}$ circle orifice. If desired, these dimensions may be varied in order to provide different, but precisely controlled, precipitation rates from different orifices if it is desired to provide more watering on one area of ground than another.

Preferably, each orifice comprises a chamber having side, upper and lower walls and an open outer end at the periphery of the head member, the side walls directing the spray radially outwardly in a pattern of arc width determined by the angle defined between the side walls. The spray range will be determined by the angle of the upper wall of the chamber, and orifices having different ranges may be provided in the same head by varying the angle of the upper wall in different orifices. In another embodiment of the invention, the head has two, oppositely directed orifices of arc width ¼ of a circle and two, oppositely directed orfices of arc width ½ of a circle, with one of the ¼ circle orfices and one of the ½ circle orifices having a spray range of 12 feet while the other two orifices each has a spray range of 15 feet. In order to achieve this, the upper wall of each orifice having a range of 12 feet has an angle of 27°, while the upper wall of each orifice having a range of 15 feet has an angle of trajectory of 30°. A range of 10 feet can be achieved with an upper wall angle or trajectory of 15 degrees.

In the preferred embodiment of the invention the nozzle is manufactured in two parts, comprising a separate base and head, and the parts are suitably welded together to provide the complete nozzle. The base has an inlet and securing mechanism at one end for coupling it to a water supply outlet, and a plurality of passageways of identical dimensions connecting the inlet to the opposite end of the base. The passageways are positioned for communication with respective orifices when the base is connected to the head, and the head includes barriers or projections for partially covering the outlet ends of at least some of the passageways when the parts are secured together in order to match the precipitation rates. This allows plug members of identical dimensions to be used, so that a removed plug does not need to be matched to a specific orifice, while still providing matched or controlled precipitation rates from different size orifices.

BRIEF DESCRIPTION OF THE DRAWINGS

The present invention will be better understood from the following detailed description of some preferred embodiments, taken in conjunction with the accompanying drawings, in which like reference numerals refer to like parts, and in which.

DESCRIPTION OF THE PREFERRED EMBODIMENT(S)

Figure 1:
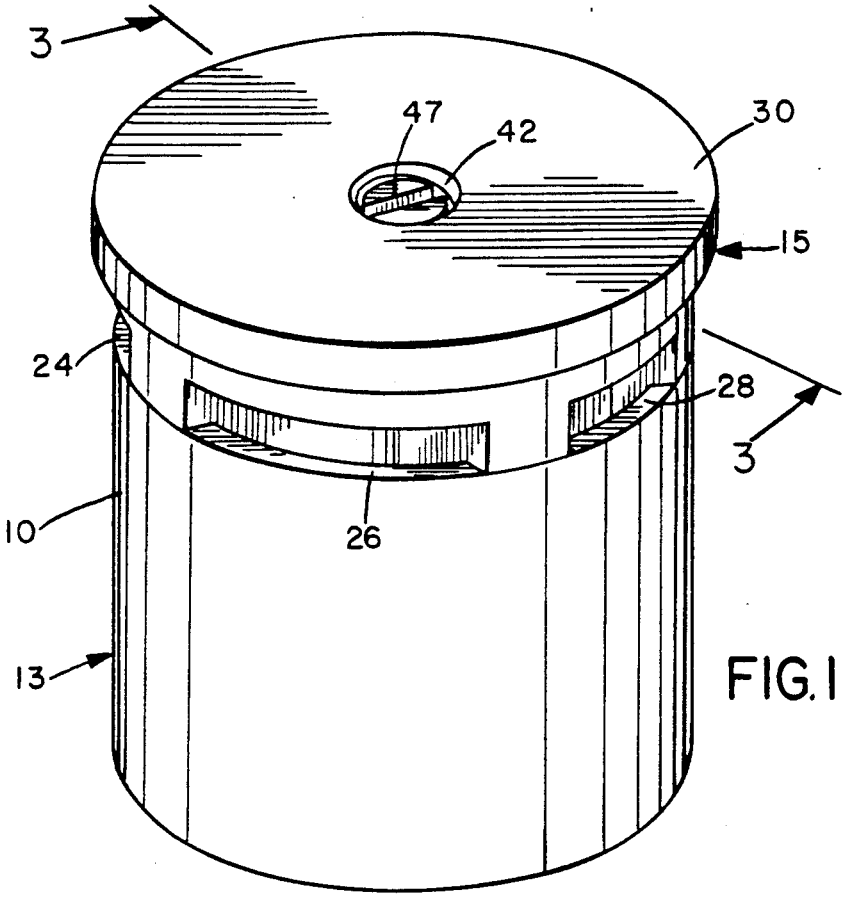
FIG. 1 is a perspective view of a sprinkler nozzle according to a first embodiment of the invention.
Figure 2:
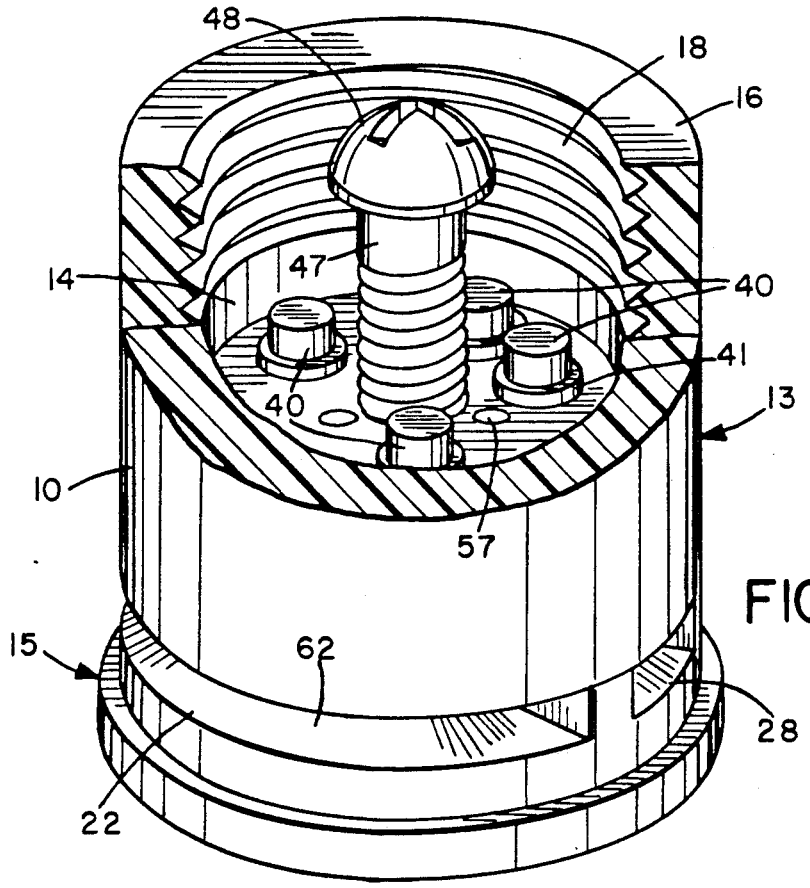
FIG. 2 is a perspective view of the sprinkler head inverted with a portion cut away.
Figure 3:
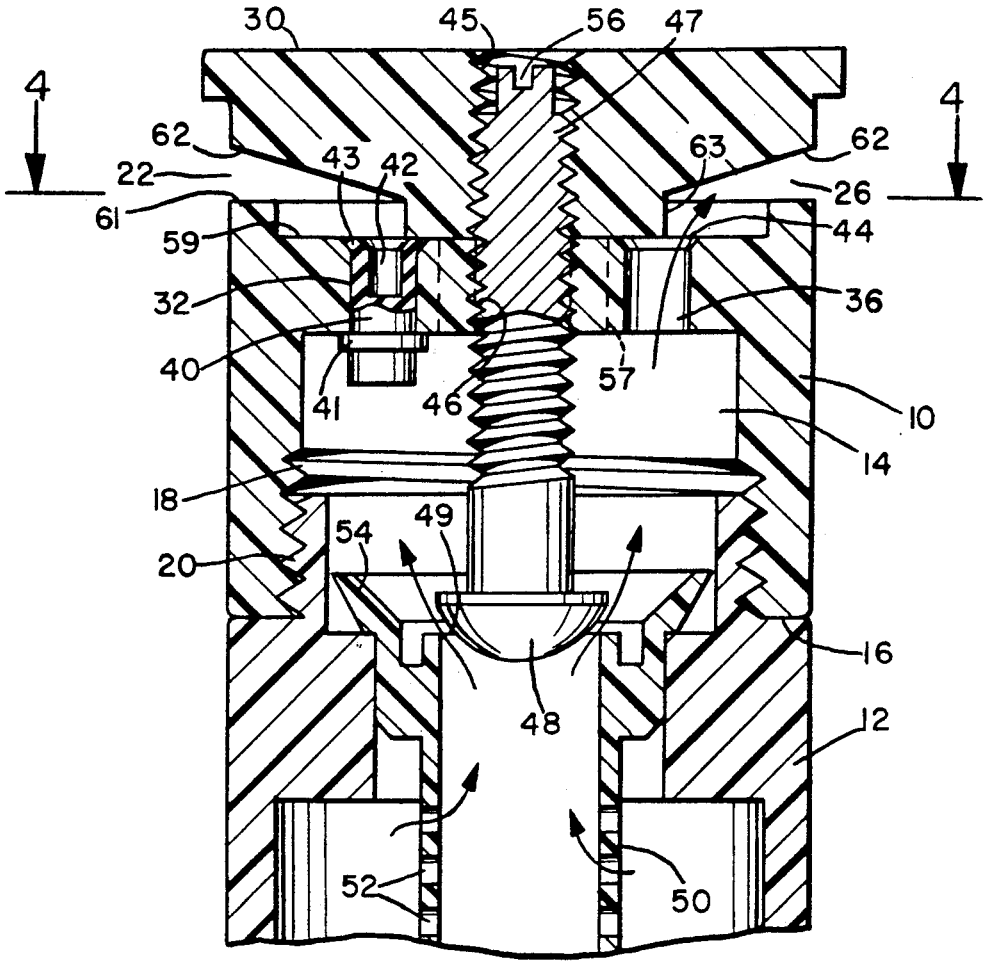
FIG. 3 is a sectional view taken on line 3—3 of FIG. 1, and with the nozzle mounted on a water supply riser.

FIGS. 1 to 4 of the drawings illustrate an adjustable sprinkler nozzle 10 according to a preferred embodiment of the present invention, which is designed to be mounted on a suitable water supply tube or riser 12, as best illustrated in FIG. 3. The nozzle 10 is a cylindrical member having a base part 13 with bore or inlet chamber 14 extending along part of its length which is open at the lower end 16 of the nozzle, and a head part 15 having a plurality of spray orifices 22, 24, 26, and 28 of various dimensions formed at spaced intervals in a ring around its periphery. The chamber 14 has internal screw threads 18 for screw threaded engagement with corresponding external screw threads 20 on an extension of riser 12, as seen in FIG. 3. In the preferred embodiments of the invention illustrated, the head and base are formed as two separate parts and subsequently welded together to form nozzle 10, as explained in more detail below, although the nozzle may be manufactured in one piece.

Figure 4:
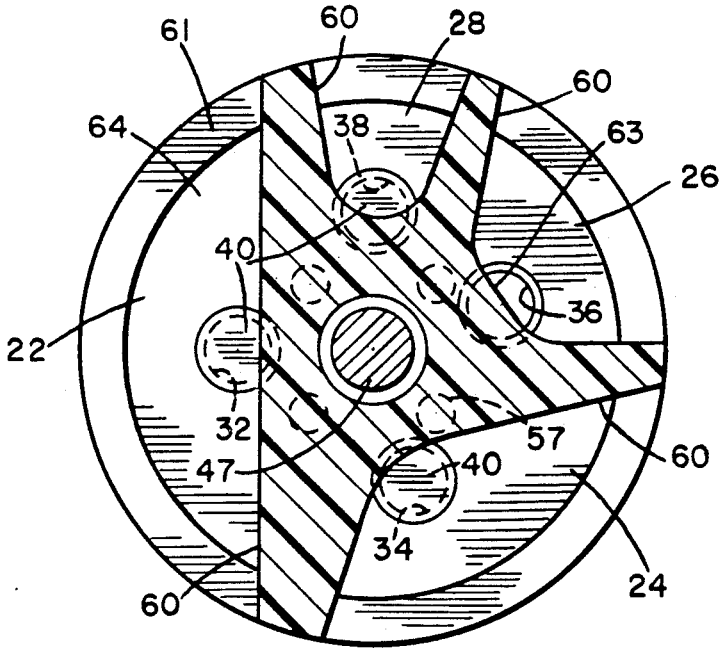
FIG. 4 is a sectional view taken on line 4—4 of FIG. 3.

The base has a plurality of axially extending internal passageways 32, 34, 36 and 38, respectively, which connect the chamber 14 with each of the orifices 22, 24, 26 and 28, respectively, when the base and head parts are secured together as illustrated in FIG. 3. Removable flow restricting plugs 40 are removably mounted in each of the passageways, as seen in FIGS. 2, 3 and 4. Each plug 40 comprises a generally cylindrical plug member of rubber or similar resilient material having an enlarged head or stop portion 41 at one end and a blind bore 42 extending inwardly from the opposite end, which has an outwardly flared lip 43 for retaining engagement with a correspondingly shaped lip portion 44 at the upper end of the passageway. This allows the plug member to be easily inserted into the passageway from its lower end, since the bore 42 allows the material of the plug to be compressed inwardly, while the lip 43 will spring out into the lip portion 44 of the passageway when the plug is fully inserted so as to retain the plug securely in position.

The base and head of the spray nozzle 10 each have a screw threaded axially extending through bore 45, 46 which together form a bore extending from outlet end 30 of the nozzle to the inner end of inlet chamber 14 when the parts are secured together, as illustrated in FIG. 3. A flow control or adjustment screw member 47 extends through bore 45, 46 and chamber 14 to control the flow rate of water from the riser 12 into the chamber 14, as best illustrated in FIG. 3. The member 47 has a convex head or valve piece 48 at its lower end which co-operates with a seat 49 on a filter member 50 mounted in the outlet end of riser 12. Filter member 50 comprises a hollow cylindrical member of mesh-like or filter screen material with openings 52, having a head 54 at one end designed for mating engagement with the outlet end of riser tube 12, as seen in FIG. 3. Adjustment screw member 47 can be rotated via adjustment notch 56 at its upper end to move it upwardly or downwardly to increase or decrease, respectively, the flow of water into the inlet chamber 14.

Figure 5:
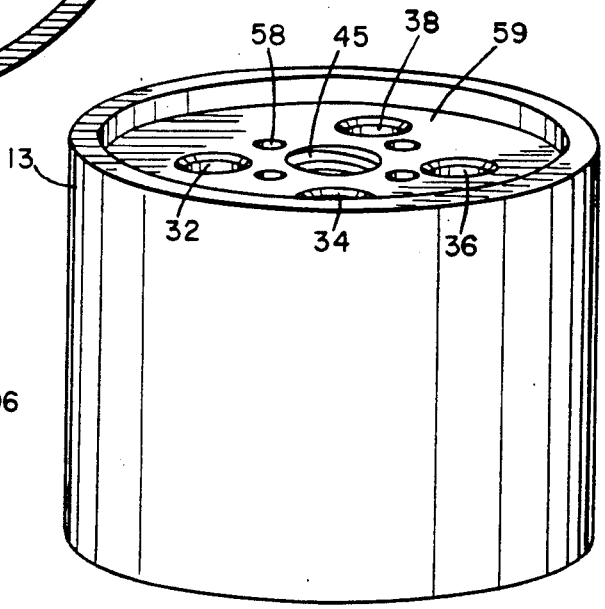
FIG. 5 is a perspective view of the base part of the nozzle.

In the embodiment illustrated in FIGS. 1 to 5, the spray orifices 22 to 28 are each designed to produce a radial spray pattern having a different arc width to all the other orifices, with the orifices directed in different directions around the spray head. Each orifice is formed by a segmental cut-out which extends from the underside of head 15 and from the outer periphery of the head inwardly to intersect the respective connecting passageway to the inlet chamber 14 when the head is secured to the base, as best seen in FIG. 3. Preferably, the head has a plurality of downwardly projecting sonic weld prongs 57 which engage in corresponding bores 58 extending from the top wall 59 of the base in order to secure the parts together in the correct orientation, as best illustrated in FIGS. 3, 4 and 5. Once the prongs 57 have been inserted in bores 58, the parts can be sonically welded together. The top wall 59 of the base has an upstanding peripheral rim or flange 61 within which the lower end of the head is located when the ports are secured together.

Each orifice in the completed nozzle is defined between the cut-out formed in the lower end of the head and the top wall 59 of the base, which forms the lower wall of each orifice. The opposite side walls 60 of each cut-out will define the spray arc width. The upper wall 62 of each cutout is preferably tapered upwardly in an outward direction, as seen in FIG. 3, so that the spray will also be directed upwardly for increased range. This angle can be varied in different heads, or in different orifices of the same head, in order to provide various different spray ranges.

The cut-out forming each orifice is arranged so that each orifice has a vertical inner end wall 63 extending from the undersurface of the head which projects partially over the respective passageway opening in the top of the base at its lower end, as best illustrated in FIGS. 3 and 4, in order to form a barrier which partially blocks the flow of water from the passageway into the orifice and controls the precipitation rate, or degree of watering, from that orifice for a particular flow rate of water. This arrangement can be used to ensure that the precipitation rates from different size orifices can be matched, if desired, or controlled in any desired manner, by varying the cross-sectional area of the passageway according to the size of the orifice, as will be explained in more detail below.

The relative sizes of the orifices in the embodiment of FIGS. 1 to 4 will provide for a large range of adjustability while allowing a full circle of spray coverage if all the orifices are open. In the embodiment illustrated in FIGS. 1 to 4, a total of four orifices is provided, with the respective arc widths of the orifices 22 to 28 comprising 180 degrees or ½ of a circle, 120 degrees or ⅓ of a circle, 90 degrees or ¼ of a circle, and 45 degrees or ⅛ of a circle, as best seen in FIG. 4. The side walls of orifice 22 together define a substantially flat or straight overall wall, as seen in FIG. 4, while the side walls of the other orifices are at the respective selected angle to one another. The orifices are arranged in order of increasing size in a clockwise direction, so that each orifice is adjacent the next largest orifice in size. This is critical in order to allow for the maximum possible adjustability, as will be explained in more detail below. Preferably, the upper end wall 30 of the spray head is marked with suitable indicia (not illustrated) adjacent and overlying each orifice indicating the arc width of the spray produced by that orifice. In the embodiment illustrated in FIGS. 1 to 4, the inner end walls of the respective orifices are arranged to overlap the respective connecting passaageways in the base by a predetermined amount in order to provide matched precipitation rates from the respective different size orifices. However, in alternative embodiments the precipitation rates may be controlled differently so that they are not matched, if desired. The passageways 32, 34, 36 and 38 have the same dimensions, and the respective inner end walls 63 overlap each of the passageways at their outlet ends by a different amount in order to compensate for the different sizes of the orifices 22, 24, 26, 28. In order to provide matched precipitation rates in the embodiment illustrated in FIG. 4, the overlap of each inner end wall is such that the effective cross-sectional area of the passageway 32 allows twice the water flow of passageway 36, four times that of passageway 38, and 1.5 times that of passageway 34. In order to provide unmatched precipitation rates, the overlap, and thus the relative sizes of the passageways, will be different.

If the precipitation rates are matched in this fashion, it can be seen that the amount of water flowing into orifice 22, which is spread over a larger area than any of the other orifices, will be greater than that flowing into the other orifices so that an area of ground watered by orifice 22 will receive the same amount of water as an equivalent area watered by any of the other orifices. In other words, the precipitation rates from the various orifices are matched. In some cases, it may be desirable to have different precipitation rates from different orifices, for example where plants having differing water requirements are to be watered, in which case the passageway sizes can be controlled to the precise watering requirements simply by arranging the inner end walls of the cut outs or orifices in the head to have the desired overlap over the respective passageway openings in the base.

Each flow restricting plug 40 is a snap or friction fit in its associated passageway. By removal of a selected plug or combination of plugs 40, spray patterns in a wide range of different arc widths can be provided. For example, if all four plugs 40 are removed, it can be seen that a full circle, or 360 degrees, of spray coverage will be provided, since the arc widths of the four outlets add up to more than 360 degrees. If only one plug is removed, spray coverage of 45 degrees, 90 degrees, 120 degrees or 180 degrees can be provided by removing the plug located in passageway 38, 36, 34 or 32, respectively. FIGS. 3 and 4 illustrate operation of the spray head when the plug 40 from passageway 36 has been removed, producing a spray of arc width 90 degrees or ¼ of a circle.

Other spray pattern sizes can be produced by removal of combinations of two or more plugs. For example, removal of the plugs associated with both outlets 26 and 28 will produce a combined outlet spray having an arc width of 135 degrees. Removal of the plugs associated with outlets 24 and 26 produces an outlet spray of arc width 210 degrees. Removal of the plugs associated with outlets 24 and 22 produces an outlet spray arc width of 300 degrees. Removal of the plugs associated with outlets 22 and 28 will produce an outlet spray of arc width 225 degrees. Removal of the plugs for outlets 28, 26 and 24 will produce an outlet spray arc width of 255 degrees. Removal of the plugs for outlets 22, 28 and 26 produces an outlet spray arc width of 315 degrees. Removal of the plugs for outlets 22, 24 and 28 produces an outlet spray arc width of 345 degrees. Thus, sprays of varying arc widths of 45, 90, 120, 135, 180, 210, 225, 255, 300, 315, 345 and 360 degrees are provided by the adjustable spray head. Thus, spray patterns having a substantial variety of arc widths can be obtained quickly and easily, simply by removal of the appropriate plug or plugs, and the head can be re-adjusted if necessary by replacement of some or all of the removed plugs and removal of one or more additional plugs. In addition to a single spray of varying arc width, two separate sprays in different directions can be provided by removal of the plugs of outlets 22 and 26 or 24 and 28. Thus, a wide variety of different possible spray patterns is provided quickly and easily in a single spray head.

Since each of the spray orifices is preformed on manufacture of the spray head to produce the respective spray pattern having the desired arc width, combinations of orifices will produce spray patterns which have arc widths which are precisely the sum of the arc widths of the selected spray orifices. The flow adjustment screw, which is externally accessible, can be adjusted after installation of the head on the riser pipe to provide the desired range for that sprinkler nozzle after the desired combination of flow restricting plugs has been removed. Thus, the desired spray pattern and spray range can be achieved quickly and easily with this spray head without needing any guesswork or repeated adjustments to water a desired area.

Figure 6:
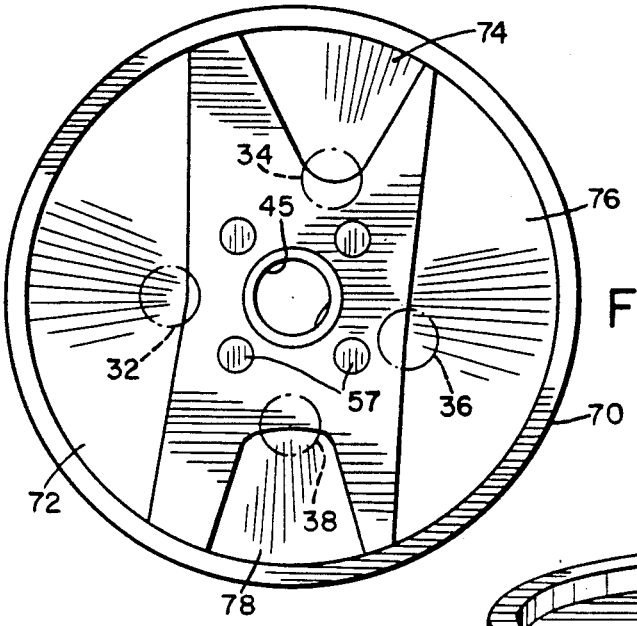
FIG. 6 is a plan view of the underside of the head part of the nozzle, in an alternative embodiment, with the position of the passageways on the top of the base part indicated in dotted outline.
Figure 7:
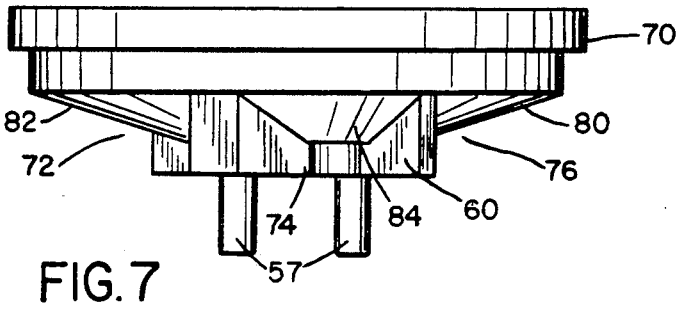
FIG. 7 is a side elevational view of the head part of the nozzle of FIG. 6.

FIGS. 6 and 7 illustrate a head 70 according to an alternative embodiment of the invention. The head 70 has orifices 72, 74, 76 and 78 of different size to those of the first embodiment. The base in this embodiment will be the same as for the previous embodiment, and like reference numerals have been used for equivalent parts. It will be understood that the exact outlet dimensions and number may be varied if desired. However, it is normally preferred that the combined arc width of all outlets is at least 360 degrees, in order to provide a full circle or 360 degrees of spray coverage, although this is not always necessary. In the embodiment illustrated in FIGS. 6 and 7, the head has two oppositely directed orifices 72 and 76 which each provide a spray of arc width corresponding to ½ of a circle, and two oppositely directed orifices 74 and 78 which produce a spray of arc width corresponding to ¼ of a circle. This head can be secured to the same standard base as the head of FIGS. 1 to 4, and is arranged to overlap the passageways 32, 34, 36 and 38 as illustrated in dotted outline in FIG. 6 so that the passageways connected to orifices 72 and 76 are of the same cross-sectional size which is double that of the passageways connected to orifices 74 and 78. This produces matched precipitation rates from all the orifices, as explained above in connection with the previous embodiment.

In the embodiment of FIGS. 6 and 7, the upper walls 80, 82 of the respective 180 degree orifices 72 and 76 are of different angles, as best seen in FIG. 7, so that sprays of different range are provided. In the illustrated embodiment, orifice 72 has a range of 15 feet (upper wall angle of 30°) while orifice 76 has a range of 12 feet (upper wall angle of 27°). Similarly, orifices 74 and 78 are arranged to have ranges of 15 feet and 12 feet, respectively, by varying the angle of the upper wall 84 of the orifices in the same way. This arrangement provides all of the most frequently used sprinkler nozzle sizes ($\frac{1}{2}$15', $\frac{1}{2}$12', $\frac{1}{4}$15', and $\frac{1}{4}$12') in a single nozzle, and at the same time matches the precipitation rates from each of the nozzle orifices.

Other popular spray patterns can be combined in a single nozzle by suitably altering the orifice sizes and passageway overlapping inner end walls to provide head parts covering the entire range of desired spray patterns. Bubbler nozzles can be provided by placing suitable walls or barriers across each of the orifices to provide a plurality of different jets from each orifice, as is known in the field. Sprays having square shapes or side strip shapes may be provided by suitable design of the orifice side walls to correspond to the desired spray shape or shapes. The manufacture of the nozzle in two parts allows the orifice dimensions and shapes to be controlled more precisely to achieve the desired matched, or unmatched but controlled, precipitation rates.

Figure 8:
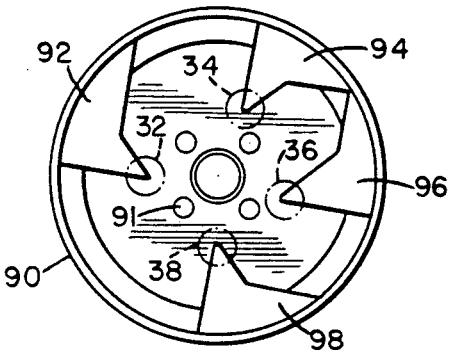
FIG. 8 is a plan view similar to FIG. 6 illustrating a head part of a nozzle according to another embodiment of the invention (Side ships).

FIG. 8 illustrates another alternative head 90 which is designed to be attached to a base similar to that illustrated in FIG. 5 but with the weld prong bores repositioned to coincide with the weld prongs 91 positioned as illustrated in FIG. 8. Head 90 has four orifices 92, 94, 96 and 98 for forming sprays of equivalent arc width but with so-called "side strips" for projecting the spray in a desired direction. In one example, orifices 92 and 96 have upper walls (not visible in the drawings) angled as in FIG. 7 to produce a spray range of 15 feet, while orifices 94 and 98 have upper walls angled to produce a spray range of 17 feet. Clearly the orifices can be arranged to produce alternative spray range combinations so that a wide range of sprinkler requirements can be provided.

Preferably, head parts of various orifice dimensions are provided so that nozzles having various desired spray patterns and precipitation rates can be assembled by attaching the appropriate head to a base. One or more standard bases may be provided, depending on the size and positioning of the orifices in the various heads. The connecting passageways are identical, but may need to be positioned differently for attachment to some heads. However, the head illustrated in FIG. 4, for example, may be provided with different spray ranges, for example three different heads having orifices of the arc width illustrated in FIG. 4 may be provided, one head having orifice upper walls inclined to produce a range of 12 feet, one having an orifice range of 10 feet, and one having a range of 8 feet. A fourth head having orifices as illustrated in FIG. 4 may be provided with barriers in each orifice to produce a bubbler. The orifice pattern illustrated in FIG. 5 may be also be provided in different heads having different spray ranges. Thus, a wide variety of different spray patterns and ranges may be provided in an efficient, precise and economical manner.

Although some preferred embodiments of the invention have been described above by way of example only, it will be understood by those skilled in the field that modifications may be made to the disclosed embodiment without departing from the scope of the invention, which is defined by the appended claims.

We claim:

1. A sprinkler nozzle, comprising:

a nozzle member having a base at one end and a head at the opposite end;

the base having an outer end and an inlet at its outer end for connection to a water supply outlet;

the head having a plurality of spaced spray orifices arranged in a ring around the outer periphery of the head for directing radial sprays in different directions, the orifices including at least two orifices of different dimensions;

the base having a plurality of internal passageways, each internal passageway connecting a respective spray orifice to the inlet;

flow restricting means removably mounted in each of said internal passageways for selectively cutting off the inlet from the respective outlet;

adjustable flow rate control means mounted in said nozzle member for controlling the flow rate of water into said inlet; and precipitation rate control means for controlling the effective cross-sectional area of each passageway to provide predetermined precipitation rates from each spray orifice for a given flow rate;

said precipitation rate control means comprising means for matching the precipitation rates from each of the orifices.

2. The nozzle as claimed in claim 1, wherein said nozzle member is formed in two separate parts comprising said base and said head, said parts each having an innermost end and being secured together at their innermost ends in a predetermined relative orientation so that each passageway communicates with a respective one of said orifices.

3. The nozzle as claimed in claim 1, wherein each orifice comprises a cut-out of predetermined shape and dimensions extending from an innermost end of said head and out to the outer periphery of said head, the cut out having opposite side walls defining the spray arc width of said orifice, and an inclined upper wall defining the spray range.

4. The nozzle as claimed in claim 1, wherein each orifice has an inclined upper wall of predetermined angle for producing a predetermined spray range.

5. The nozzle as claimed in claim 4, wherein orifices of at least two different spray ranges are provided.

6. The assembly as claimed in claim 1, wherein the arc widths of the orifices vary from $\frac{1}{8}$ to $\frac{1}{2}$ of a circle.

7. The assembly as claimed in claim 6, wherein there are four orifices having arc widths of $\frac{1}{8}$, $\frac{1}{4}$, $\frac{1}{3}$ and $\frac{1}{2}$ of a circle, respectively.

8. The assembly as claimed in claim 6, wherein the orifices are arranged sequentially in order of increasing size around the periphery of the head member.

9. The assembly as claimed in claim 1, wherein said base member has a bore open at its outer end forming an inlet chamber comprising said inlet, and said passageways connect each orifice to said inlet chamber, said nozzle member having an axial through bore connecting said inlet chamber to the opposite end of said head member, and said flow control means comprising a valve member adjustably mounted in said axial through bore and projecting into said chamber for controlling the size of said water supply outlet connection to said inlet chamber.

10. A sprinkler nozzle, comprising:

a nozzle member having a base at one end and a head at the opposite end;

the base having an outer end and an inlet at its outer end for connection to a water supply outlet;

the head having a plurality of spaced spray orifices arranged in a ring around the outer periphery of the head for directing radial sprays in different directions, the orifices including at least two orifices of different dimensions;

the base having a plurality of internal passageways, each internal passageway connecting a respective spray orifice to the inlet;

flow restricting means removably mounted in each of said internal passageways for selectively cutting off the inlet from the respective outlet;

adjustable flow rate control means mounted in said nozzle member for controlling the flow rate of water into said inlet;

precipitation rate control means for controlling the effective cross-sectional area of each passageway to provide predetermined precipitation rates from each spray orifice for a given flow rate;

said nozzle member being formed in two separate parts comprising said base and said head, said parts each having an innermost and an outer end and being secured together at their innermost ends in a predetermined relative orientation so that each passageway communicates with a respective one of said orifices; and said passageways being of identical dimensions and said precipitation rate control means comprising barrier means in at least some of said orifices for projecting partially over the associated passageway to control the cross-section of said passageway to provide a predetermined precipitation rate.

11. A sprinkler nozzle, comprising:

a nozzle member having a base at one end and a head at the opposite end;

the base having an outer end and an inlet at an outer end for connection to a water supply outlet;

the head having a plurality of spaced spray orifices arranged in a ring around the outer periphery of the head for directing radial sprays in different directions, the orifices including four orifices having arc widths of $\frac{1}{8}$, $\frac{1}{4}$, $\frac{1}{3}$ and $\frac{1}{2}$ of a circle, respectively;

the base having a plurality of internal passageways, each internal passageway connecting a respective spray orifice to the inlet;

flow restricting means removably mounted in each of said internal passageways for selectively cutting off the inlet from the respective outlet;

adjustable flow rate control means mounted in said nozzle member for controlling the flow rate of water into said inlet;

precipitation rate control means for controlling the effective cross-sectional area of each passageway to provide predetermined precipitation rates from each spray orifice for a given flow rate;

said precipitation rate control means comprising barrier means for at least partially blocking at least some of the passageways to provide passageways of different cross-sectional area connected to each of the respective orifices, the cross-sectional area of the passageway connected to the $\frac{1}{2}$ circle orifice being 1.5 times the size of that connected to the $\frac{1}{3}$ circle orifice, twice the size of that connected to the $\frac{1}{4}$ circle orifice, and four times the size of that connected to the $\frac{1}{8}$ circle orifice.

12. A sprinkler nozzle, comprising:

a nozzle member having a base at one end and a head at the opposite end;

the base having an outer end and an inlet at an outer end for connection to a water supply outlet;

the head having a plurality of spaced spray orifices arranged in a ring around the outer periphery of the head for directing radial sprays in different directions, the orifices including at least two orifices of different dimensions;

the base having a plurality of internal passageways, each internal passageway connecting a respective spray orifice to the inlet;

flow restricting means removably mounted in each of said internal passageways for selectively cutting off the inlet from the respective outlet;

adjustable flow rate control means mounted in said nozzle member for controlling the flow rate of water into said inlet;

precipitation rate control means for controlling the effective cross-sectional area of each passageway to provide predetermined precipitation rates from each spray orifice for a given flow rate;

said base having a bore open at its outer end forming an inlet chamber comprising said inlet, and said passageways connect each orifice to said inlet chamber, said nozzle member having an axial through bore connecting said inlet chamber to the opposite end of said head member, and said flow control means comprising a valve member adjustably mounted in said axial through bore and projecting into said chamber for controlling the size of said water supply outlet connection to said inlet chamber; and each passageway extending parallel to the axis of said nozzle member, and each flow restricting means comprising a separate plug member removably mounted in its associated passageway.

13. The assembly as claimed in claim 12, wherein each plug member comprises a cylindrical shaft which is a releasable force fit in the associated passageway, and a stop portion of increased diameter adjacent one end for engagement with an inner end wall of said inlet chamber adjacent said passageway.

14. The assembly as claimed in claim 13, wherein each plug member has a blind bore extending inwardly from its opposite end to said stop portion for allowing said plug member to be compressed for easy insertion into said passageway.

* * * * *